United States Patent [19]

Kilroy

[11] 4,032,195

[45] June 28, 1977

[54] PUSH-PULL MINING SYSTEM

[76] Inventor: Oliver B. Kilroy, 5 Calle Corta, Tucson, Ariz. 85716

[22] Filed: July 19, 1976

[21] Appl. No.: 706,916

Related U.S. Application Data

[63] Continuation-in-part of Ser. No. 578,312, May 16, 1975, Pat. No. 3,993,354.

[52] U.S. Cl. ..... 299/19; 299/18

[51] Int. Cl.[2] ..... E21C 35/20; E21C 41/04

[58] Field of Search ..... 299/18, 19

[56] References Cited

UNITED STATES PATENTS

| | | | |
|---|---|---|---|
| 3,790,214 | 2/1974 | Kilroy | 299/19 X |
| 3,924,895 | 12/1975 | Leasure | 299/18 X |
| 3,942,841 | 3/1976 | McCain et al. | 299/18 X |

FOREIGN PATENTS OR APPLICATIONS

| | | | |
|---|---|---|---|
| 2,350,874 | 4/1974 | Germany | 299/18 |

*Primary Examiner*—Ernest R. Purser
*Attorney, Agent, or Firm*—John A. Robertson

[57] ABSTRACT

A push-pull mining system comprising a pre-formed arrangement of personnel entry shafts, laterally extending service tunnels, flumes in the form of ditches extending substantially throughout each service tunnel, a holding tunnel at one side of each service tunnel and a chamber below the lowermost service tunnel at the end opposite to the holding tunnel for receiving a separation tank, a slurry mix tank, and an underground water reservoir. A mobile mining unit, comprising a mining machine at each end and carriers therebetween, is of substantially the same length as the holding tunnel. The mobile mining unit moves across the service tunnel to mine the opposing face and form a working tunnel which when finished is of the same length as the mobile unit. A mobile water station is mounted in the service tunnel and is connected to the mid-carrier which conveys the water to the mining machine at the end which is effective. A slurry line extends from a slurry mix tank in each mining machine to the midcarrier where it is connected to a main slurry line by a three-way valve. The slurry line extends along a working tunnel and is then diverted or bent into the service tunnel. A reverse drive motor is positioned in the service tunnel and engages the main slurry line to move it in reverse directions as the mobile mining unit moves back and forth across the service tunnel to form additional working tunnels. The slurry line opens onto the flume when in a retracted position but when advanced to a predetermined extent enters the upper end of a downflow slurry tube. The latter extends to a separation tank from which mineable material is passed to a main slurry mix tank. It is moved outwardly to the ground surface through a tube. Water for the slurry mix tanks in the mining unit is supplied from either a surface reservoir or an underground reservoir.

16 Claims, 16 Drawing Figures

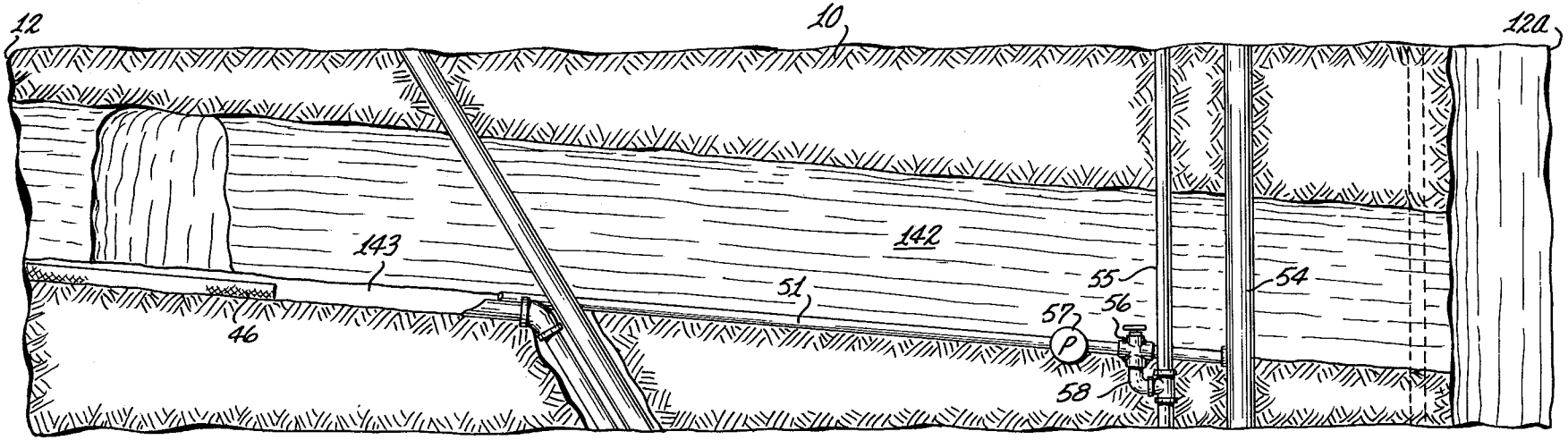
Fig-2
Fig-3
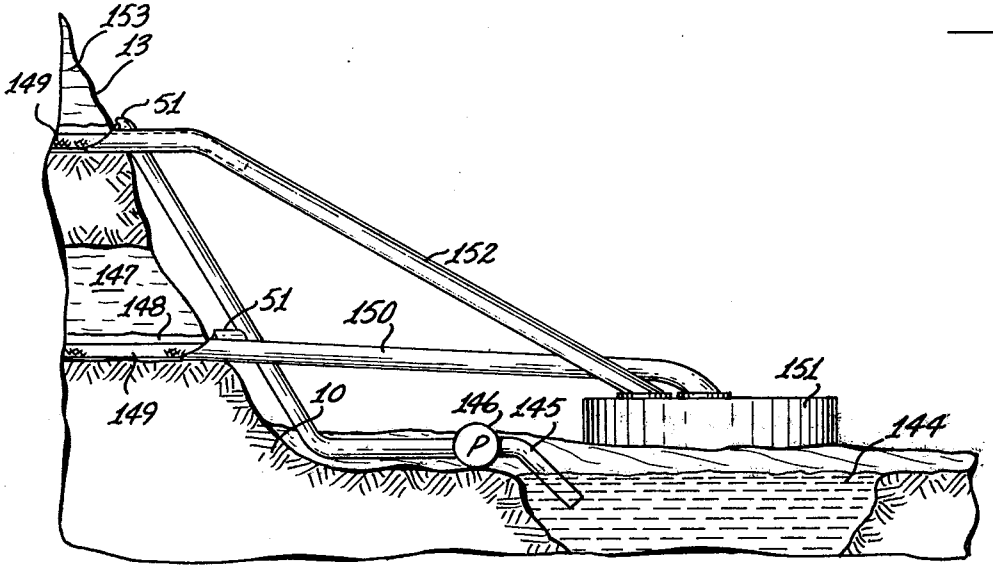

PUSH-PULL MINING SYSTEM

This application is a Continuation-In-Part of the copending application of Oliver B. Kilroy, Ser. No. 578,312, filed May 16, 1975, for Multi-Level Hydraulic Mining System now U.S. Pat. No. 3,993,354. Also, it is based on Disclosure Document No. 047302.

The present invention relates to mining and is concerned primarily with a so called push-pull system in which a mobile unit is moved back and forth across a service tunnel to remove mineable material from the side faces thereof and eventually form a plurality of working tunnels in stepped relation with each working tunnel having a length substantially the same as that of the mobile mining unit.

BACKGROUND OF THE INVENTION

The nation is presently faced with an energy shortage which is worsening at a rapid rate. Many people believe that the only way this condition can be relieved is to enlarge the use of coal and oil derived from rock shale with the corresponding reduction of the need for petroleum. There are known systems for mining coal and mineable materials which include the features of being multi-level and which convert the mined material into a slurry and pump the slurry to the ground surface. It is also known to derive power from a column of water which downflows from a surface reservoir to an underground reservoir and use the power to pump the slurry from a slurry mix tank through an upflow tube.

It is believed that none of these known mining systems are adapted to effect the efficiencies and economies that are required. Also, the application of retreat mining as disclosed herein will offer safety features with regard to personnel entrapped underground.

OBJECTS OF THE INVENTION

With the foregoing conditions in mind, the present invention has in view the following objectives:

1. To provide a mining system including a pre-formed arrangement of at least one shaft for personnel and equipment entry, a plurality of service tunnels extending laterally from said shaft and at different levels, a flume formed in the floor of each service tunnel, having a declined section to effect gravity flow, and extending therethroughout and a chamber below the lowermost service tunnel.

2. To provide, in the mining system of the character aforesaid, a so called holding tunnel at one side of each service tunnel and at the end thereof adjacent to one possible entry provided for personnel and equipment.

3. To provide, in a mining system of the type noted, a mobile mining unit which is positioned in and has substantially the same length as the holding tunnel and has a mining machine at each end thereof.

4. To provide, in a mining system of the kind described, a mobile mining unit in which each mining machine includes a slurry mix tank. The mobile unit also includes a plurality of mobile carriers between the mining machines including a mid-carrier.

5. To provide, in a mining system of the character aforesaid, a fixed water line which extends between the mining machines and is supported by the carriers including the mid-carrier. A mobile water station is connected to this water line at the midpoint carrier by a three-way valve.

6. To provide, in a mining system of the kind described, a flexible water line from the water station to the fixed water line at the three-way valve.

7. To provide, in a mining system of the type noted, a fixed slurry line which extends between the mining machines and is supported by the carriers.

8. To provide, in a mining system of the kind described, a flexible main slurry line one end of which is connected to the fixed slurry line at the mid-point carrier by a three-way valve and which flexible slurry line extends into the service tunnel.

9. To provide, in a mining system of the character aforesaid, power means for imparting pushes and pulls to and on the flexible slurry line.

10. To provide, in a mining system of the type noted, mechanism which accommodates the making of a turn by the flexible slurry line from a working tunnel into a service tunnel.

11. To provide, in a mining system of the kind described, a separation tank which is positioned in the chamber below the lowermost service tunnel, at which area another entry shaft is located for personnel and equipment and from which tank upstand a plurality of slurry tubes each of which terminates at the flume in a service tunnel.

12. To provide, in a mining system of the character aforesaid, friction reducing means in the upper end portion of each slurry tube to facilitate the entry thereinto, movement therein, and removal therefrom of an end portion of a flexible slurry line.

13. To provide, in a mining system of the type noted, a main slurry mix tank which is connected to the separation tank and an underground reservoir.

14. To provide, in a mining system of the kind described, a water supply line which extends to a water station in each service tunnel and extends from a source of water supply.

15. To provide, in a mining system of the character aforesaid, a mobile mining unit including a mining machine at each end which is of the so called hybrid type, thus, it includes both mechanical and hydraulic mining devices.

Various other more detailed objects and advantages of the invention, such as arise in connection with carrying out the above ideas in a practical embodiment will, in part, become apparent and, in part, be hereinafter stated as the description of the invention proceeds.

SUMMARY OF THE INVENTION

The foregoing objects are achieved by first providing a pre-formed arrangement of service tunnels which extend into the formation to be mined from a surface having a vertical component such as a shaft or a hillside which affords an entry into the service tunnels by personnel or for equipment. These service tunnels are at different levels and may assume different angular relations with respect to the surface at the point of entry. A so called holding tunnel is formed at the end of each service tunnel adjacent to an entry end thereof and which extends laterally therefrom at one side and preferably at an angle other than being normal thereto. A flume is formed in the floor of each service tunnel centrally thereof and preferably extends throughout its length and when practicable affords gravity flow of the slurry towards the separation tank.

A chamber is formed below the lowermost service tunnel and positioned therein is a separation tank, a main slurry mix tank, and an underground water reservoir.

A mobile mining unit is first positioned in the holding tunnel. It has a length substantially equal to that of the holding tunnel and during its operation forms a first working tunnel in alignment with the holding tunnel and of the approximate length of the mining unit; a second working tunnel rearward of and parallel to the working tunnel, a third working tunnel in alignment with the second working tunnel and so on throughout the formation to be mined in a manner of retreat mining. In each case, the working tunnel is of the approximate length of the mobile mining unit.

The mobile mining unit comprises a mining machine at each end which may be either a conventional mechanical mining machine or a hybrid machine including both mechanical and hydraulic mining devices. As the name mobile mining unit implies, the mining machines are mounted on wheels that are carried by axles which enable it to make turns. Between the mining machines are a plurality of carriers each of which is also mounted on wheels and which include a mid-carrier. Each mining machine includes a slurry mix tank. A fixed water line extends from one mining machine to the other being connected to the slurry mix tanks therein and is supported by the mobile carriers. A fixed slurry line also extends between the mining machines being connected at each end to the slurry mix tank of that machine and is supported by the carriers. The carriers include a mid-carrier which is located equidistantly between the mining machines. A mobile water station is positioned in the service tunnel forward of the holding tunnel and working tunnel which will align therewith when it is formed. This water station is connected to a source of water supply which may be either a surface reservoir or the underground reservoir.

A flexible water tube extends from the water station to the mid-point carrier where it is connected to the fixed water line by a three-way valve which provides for water being supplied to the slurry mix tank of one mining machine to the exclusion of the slurry mix tank of the other mining machine.

A fixed slurry line extends from the slurry mix tank of one mining machine to the slurry mix tank of the other and is supported by the carriers passing through the mid-point carrier. At the mid-point carrier a flexible slurry line is connected to the fixed slurry line by a three-way valve which establishes communication between the flexible slurry line and the slurry mix tank of one mining machine to the exclusion of the other.

The flexible slurry line has a length related to that of the mobile unit and the service tunnel. Thus, it must have a length at least slightly in excess of one-half the length of the mobile unit thereby enabling it to be turned or bent into the service tunnel when the mobile mining unit reaches a limit of position in a working tunnel and provide sufficient length for it to be engaged by power means for assisting in imparting a push or pull thereto. This excess of length of one-half the length of the mobile mining unit will depend on the length of the service tunnel. This power unit may take any of several forms.

The important features are that that portion of the flexible slurry line which is located in the service tunnel be held against lateral displacement to center the flexible slurry line over the flume in the service tunnel and it also must provide a driving engagement with and for the flexible slurry line. One such power unit comprises a frame which is mounted in the flume and held against motion relative thereto. Mounted in this frame is a reversible electric motor which through appropriate gears rotate wheels which engage the flexible slurry line. The flexible slurry line is supported by removable wheels which ride on the floor of the working tunnel and on the floor of the service tunnel or the flume therein. These wheels are removed as they approach the power unit and replaced after that particular portion of the flexible slurry line passes the power unit.

The flume in each service tunnel, which has a declined section, is in the form of an open ditch, lined or unlined, and terminates at an elbow which is mounted on the upper end of a slurry tube which extends upwardly from the separation tank. At the beginning of the movement when the mining machine is first retracted from its innermost position, the flexible slurry line opens onto the declined portion of the flume and the slurry is discharged therefrom into the flume and flows therealong until it enters the upper end of the slurry tube. As this movement continues the free end of the slurry line approaches the elbow and ultimately is inserted thereinto. To facilitate this action, friction reducing devices are provided. These may be on an end portion of the slurry line or within the elbow and upper end portion of the slurry tube.

The mining machine at each end of the mobile mining unit may be of a conventional type in which mechanical ore cutting elements are swung laterally on a horizontal plane to form a working tunnel which is wider than the mining machine itself. As an alternative, it may be of a hybrid type in which a hydraulic jet is applied to the face above and behind the recess which is formed by the mechanical mining device.

As the characteristic feature of the present invention is the push-pull operation of the flexible slurry line, the mining machine may include power traction devices and this is also true of the carriers. Any or all of the carriers may be provided with ball mills or other devices for reducing the size of the ore aggregate to insure the proper flow thereof through the slurry lines.

From the slurry mix tank in the lowermost level, the slurry is pumped upwardly through an out-flow tube to the ground surface. This pump may be powered by any appropriate source such as by the energy derived from a column of water which flows downwardly from the surface reservoir to the underground reservoir For a full and more complete understanding of the invention, reference may be had to the following description and accompanying drawings wherein:

FIG. 2 is another vertical section through the mining formation in which a service tunnel is inclined.

FIG. 3 is a vertical section through a mining formation formed in the side of a hill.

DESCRIPTION OF A PREFERRED EMBODIMENT

Figure 1:
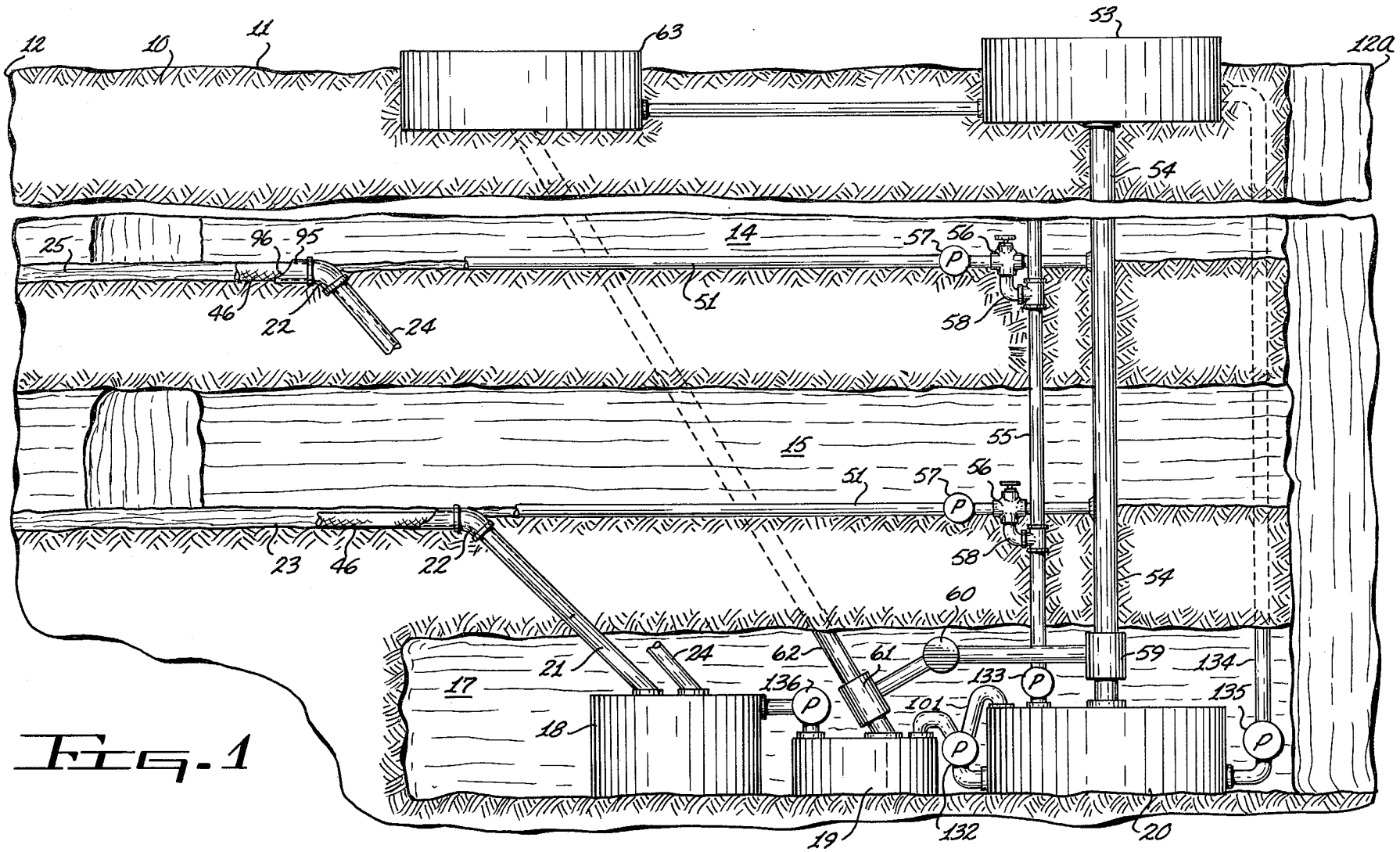
FIG. 1 is a vertical section through a portion of an earth formation to be mined and in which the service tunnels are horizontal.

Referring now to the drawings wherein like reference characters denote corresponding parts throughout the several figures: The arrangement of service tunnels and related excavations will first be described with reference to FIGS. 1, 2, and 3.

An earth formation to be mined is designated 10. It includes an upper surface 11. An entry for service tunnels to be formed may take the form of a vertical shaft which may be located to the left of the line 12, or the right of line 12*a*, in FIG. 1, or it may be the side of a hill such as shown at 13 in FIG. 3. This hillside 13 is not actually the entry for personnel or vehicles and is merely referred to as being typical of a hillside which would provide such entry. Extending horizontally from the entry surface are a plurality of horizontal service tunnels shown at 14 and 15. These tunnels are at different levels and it is to be understood that more service tunnels may be provided at other levels.

Figure 4:
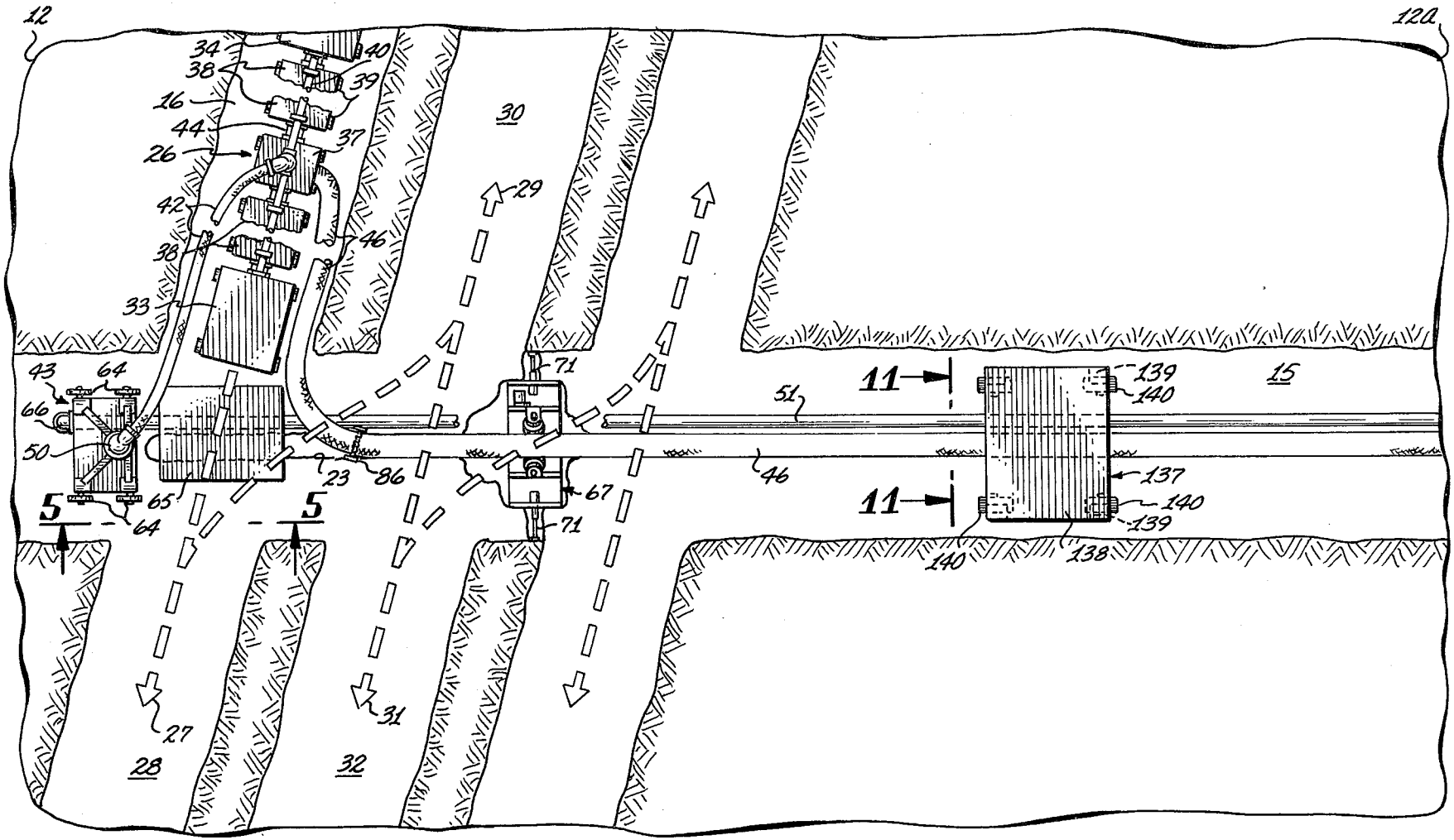
FIG. 4 is a diagrammatic view taken on a horizontal section through the mining formation immediately above the service tunnel.

Referring for the moment to FIG. 4, it will be noted that a holding tunnel 16 extends laterally from one side of service tunnel 14 and is preferably at an angle relative to service tunnel 14 which is not a right angle. Such a holding tunnel is provided at approximately the same place for each of the service tunnels.

Referring again to FIG. 1, a chamber 17 is formed below the service tunnel 15. Positioned in chamber 17 is a separation tank 18, a main slurry mix tank 19, and an underground reservoir 20. Upstanding from separation tank 18 but at an acute angle relative thereto is a slurry tube 21 which extends to intersect the flume in the floor of service tunnel 15 where an elbow 22 is mounted thereon. A flume 23 is formed in the floor of service tunnel 15 centrally thereof, has a declined portion, and extends to elbow 22. Likewise, a slurry tube 24 extends upwardly from separation tank 18 to approximately the floor of service tunnel 14 where it is provided with an elbow 22. Service tunnel 14 is formed with a central flume 25 similar to flume 23. It will be understood that a slurry tube similar to tubes 21 and 24 is provided for each service tunnel which will also have a flume similar to flumes 23 and 25.

As shown in FIG. 4, a mobile mining unit designated in its entirety at 26 is positioned in holding tunnel 16. Mobile mining unit 26 has a longitudinal extent substantially equal to that of holding tunnel 16. It is intended that it be moved in the directions of arrow 27 to form a working tunnel 28 and thence pulled backwardly in the direction of arrowhead 29 to form another working tunnel 30. It is then moved in the direction of arrowhead 31 to form another working tunnel 32 and so on to form a series of working tunnels all of which are substantially in alignment and each of which is of substantially the same length as mobile mining unit 26. As many of these working tunnels are formed as can be accommodated by the mining formation 10.

MOBILE MINING UNIT

Figure 12:
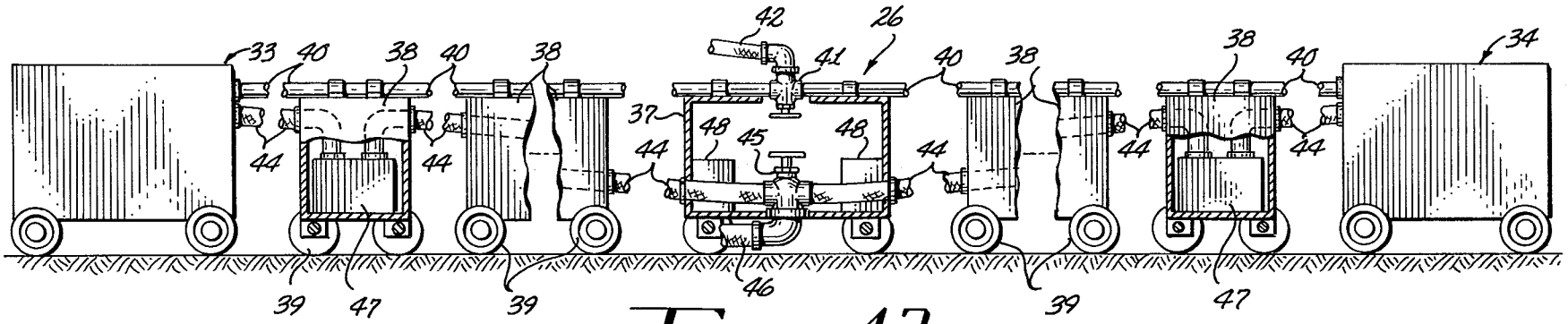
FIG. 12 is a side elevation somewhat diagrammatic of the mobile mining unit taken on the plane of line 12—12 of FIG. 6.
Figure 13:
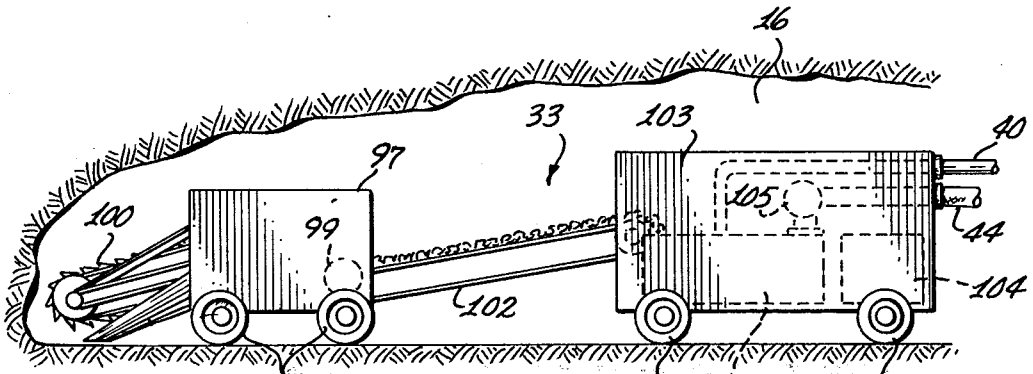
FIG. 13 is a side view also somewhat diagrammatic of a conventional mining machine.
Figure 15:
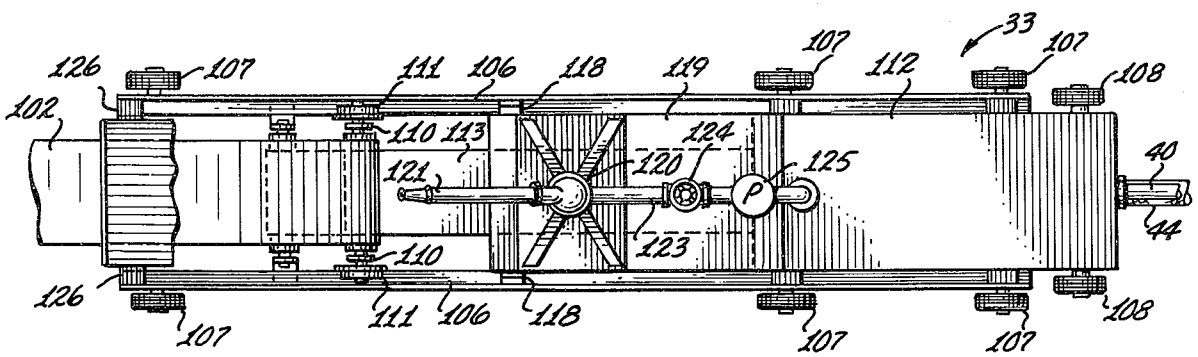
FIG. 15 is a top plan view of the mining machine of FIG. 14 with parts broken away.
Figure 14:
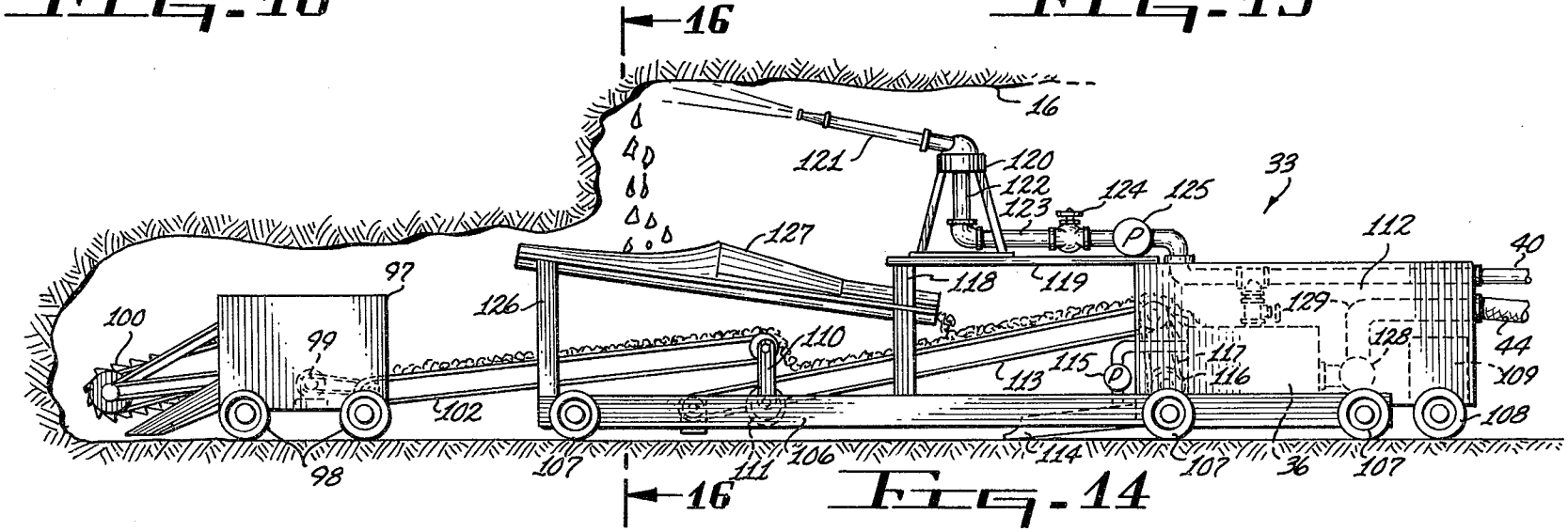
FIG. 14 is a side elevation somewhat schematic of a hybrid mining machine.

Referring now in particular to FIG. 12, mobile mining unit 26 will be described in detail. It comprises two mining machines 33 and 34 located at opposite ends of the unit. These mining machines may be of a conventional mechanical cutting type as illustrated in FIG. 13 and will be later described in detail or of a hybrid type combining mechanical and hydraulic mining devices as illustrated in FIGS. 14 and 15 and to be later described. In each case they will include a slurry mix tank such as shown at 35 in FIG. 13 and at 36 in FIG. 14.

Between mining machines 33 and 34 are a plurality of carriers which include a mid-carrier 37. In the embodiment illustrated in FIG. 12 there are four carriers 38 arranged two on each side of mid-carrier 37 and it is to be understood that the number of these additional carriers 38 may vary depending on the length of unit 26. Each of the machines 33 and 34 and carriers 37 and 38 is mounted on wheels 39 with a pair of wheels being mounted at the ends of a pivoted axle to enable the unit to make the turns indicated in FIG. 4.

Figure 5:
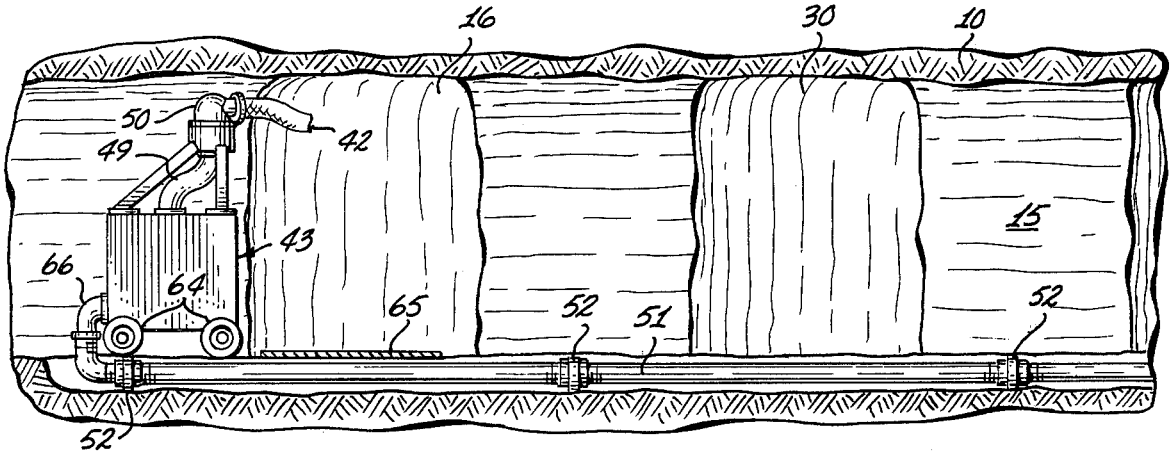
FIG. 5 is a detail taken as a vertical section along the line 5—5 of FIG. 4.
Figure 6:
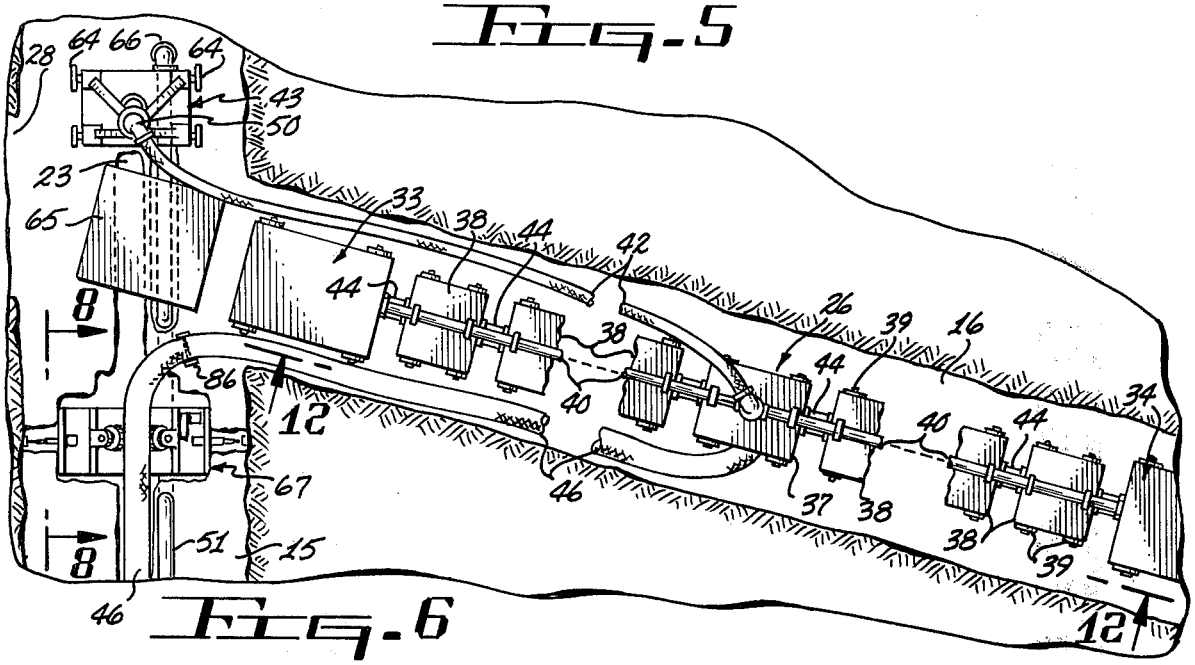
FIG. 6 is a detail taken as a top plan over the junction of the holding tunnel or a working tunnel with a service tunnel with the mining unit in position on one side of the service tunnel.
Figure 7:
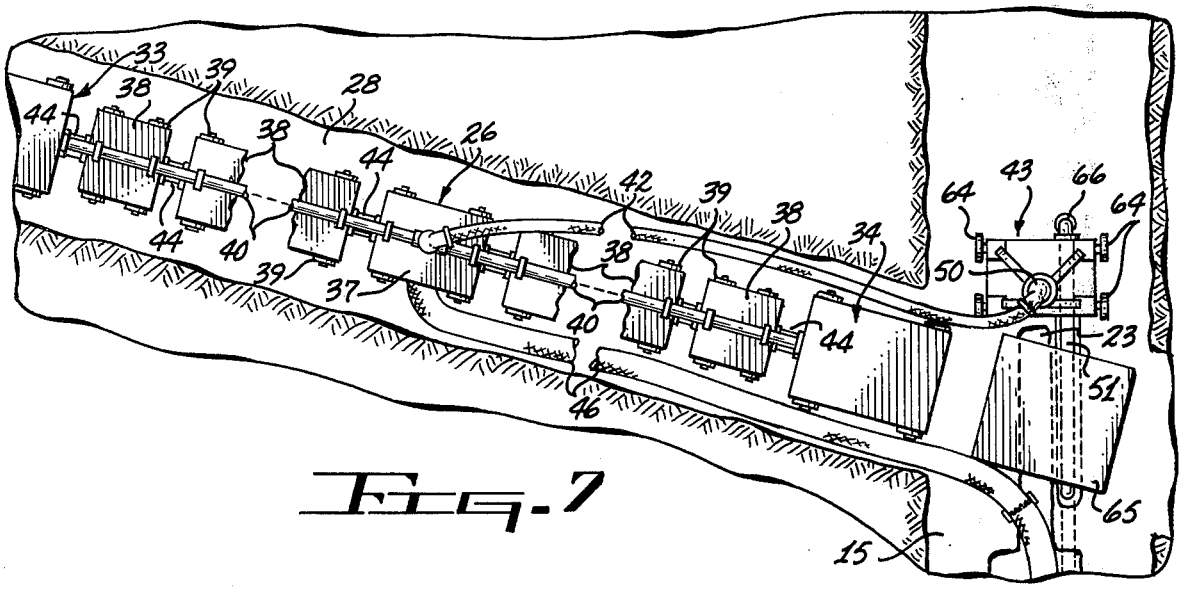
FIG. 7 is a view similar to FIG. 6 depicting the mining unit in position on the other side of the service tunnel.

A fixed water line 40 extends from machine 33 to machine 34 and is mounted on the tops of the carriers 37 and 38 centrally thereof. This arrangement being more clearly depicted in FIGS. 6 and 7. As shown in FIG. 13, each end of water line 40 discharges into a slurry mix tank in the mining machine. At midpoint carrier 37, water line 40 is provided with a three-way valve 41 which is connected by a flexible conduit 42 to a mobile water station 43 which is illustrated in FIGS. 5, 6, and 7. It is evident that a three-way valve 41 may be operated to deliver water to the slurry mix tank 35 of either of the mining machines 33 and 34 to the exclusion of the other.

A fixed slurry line 44 extends between the slurry mix tank of each mining machine 33 and 34 and passes through the various carriers centrally thereof. At mid-carrier 37 fixed slurry line 44 is provided with a three-way valve 45. This three-way valve is connected to a flexible slurry line 46 which is more clearly shown in FIGS. 6 and 7. At this point it is well to note that while the fixed slurry line 44 may extend from elevated points in mining machines 33 and 34 downwardly at a slight incline to the mid-carrier, as shown in FIG. 12, and in so doing it passes directly through the carriers 38. However, it is recognized that grinding devices such as ball mills might be included in one or more of the carriers 38 to reduce the mined material aggregate to a size commensurate to the slurry being freely flowable through the slurry lines. Thus, the carrier 38 adjacent each mining machine is shown as including a ball mill represented diagrammatically at 47.

It may also be desirable to include in mid-point carrier 37 a power source such as an electric motor, diagrammatically represented at 48, to drive the wheels of that carrier and thus provide additional driving forces for moving the unit.

Referring now more particularly to FIG. 5, which may be considered along with FIG. 1, the mobile water station 43 includes a stand pipe 49 having a swivel coupling 50 at its upper end to which flexible conduit 42 is connected. Water is supplied to stand pipe 49 by water line 51 comprising various sections which are connected by couplings 52. A water line 51 extends along the floor of each service tunnel being laid therein and is connected to an appropriate source of water. This source of water may be either a surface reservoir 53 or underground reservoir 20. A downflow tube 54 extends between the reservoirs and an upflow tube 55 extends from underground reservoir 20 to the uppermost service tunnel. Each water line 51 is connected directly to downflow tube 54 with a three-way valve 56 being included therein together with a pump 57. An elbow 58 connects valve 56 with upflow tube 55. Thus, water from either the tubes 54 or 55 may be supplied to water line 51 and under the pressure of pump 57 by proper operation of valve 56. To complete the description of this phase of the construction it will be noted from FIG. 1 that a turbine 59 is included in downflow tube 54 and through gearing represented diagrammatically at 60 drives a pump 61 included in an upflow conduit 62 through which slurry is pumped from slurry mix tank 19 to a tank 63 at ground surface 11.

It will be understood from reference to FIG. 4 that after a working tunnel such as at 28 or 30 is completed, the water station 43 must be moved along the service tunnel in retreat fashion to properly position it for formation of the next pair of working tunnels. Thus, the water station 43 is provided with wheels 64. These wheels will ride over grills such as shown at 65 which cover flume 23 or 25. To accommodate such movement a a section of water line 51 (FIG. 5) is removed after closing the valve 56 for that line. The removal is accomplished by uncoupling the pipe section adjacent to station 43, removing it and then attaching the next adjacent coupling 52 to the U shaped fixture 66.

POWER DRIVE FOR FLEXIBLE SLURRY LINE

Figure 9:
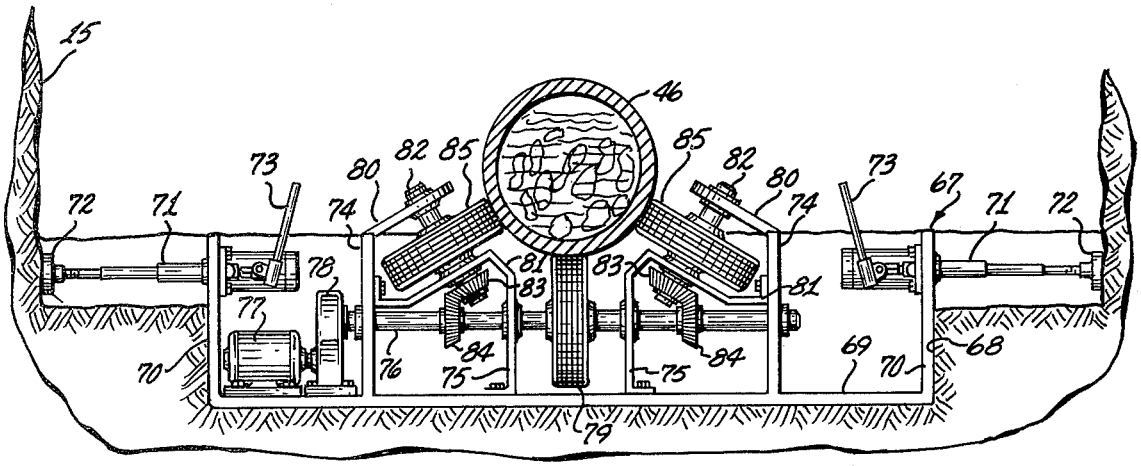
FIG. 9 is a detail taken on an enlarged scale of the power unit, being taken on the plane of the line 9—9 of FIG. 8.

With reference to FIGS. 4 and 9, it is evident that as the mobile mining unit 26 moves from the holding tunnel 16 to form working tunnel 28 flexible slurry line 46 makes a bend or turn and a pull is exerted thereon by a power unit which also imparts a thrust to the slurry line after it passes the power unit. The power unit is designated generally 67. A rectangular shaped pit 68 is formed in the bottom of flume 25 and in the floor of service tunnel 14 where necessary, and in which is fitted an anchoring frame comprising a floor 69, and side walls 70. The side walls 70 extend above the floor of the flume and mounted on that portion of each side wall above the floor of the flume and in a groove cut in the floor of service tunnel 14 is a jack 71 having a foot 72 which is urged against the side of service tunnel 14 by operation of handle 73. Jacks of this type are well known and further description of the details thereof are believed to be unnecessary for the purposes of this specification.

Upstanding from floor 69 at distances spaced from side walls 70 are two intermediate walls 74. Two brackets 75 are also mounted on floor 69 and arranged symetrically with respect to walls 74. A shaft 76 is journalled in walls 74 and 75 and is driven by an electric motor 77 through the medium of a gear reducing unit 78. The motor 77 is reversible to provide a drive in either direction.

Driveably mounted on shaft 76 between brackets 75 is a driving wheel 79 which engages the under side of flexible slurry line 46. The upper end of each wall 74 is provided with an inwardly inclined tab 80 and the upper end of each bracket 75 is provided with an extension 81 which is anchored to wall 74. A stub shaft 82 is journalled in tab 80 and extension 81 and at its lower or inner end a bevel gear 83 is driveably mounted thereon. Each of these bevel gears 83 mesh with a complement gear 84 that is driveably mounted on shaft 76. A driving wheel 85 is mounted on each stub shaft 82 and is non-rotatable with respect thereto so that it is driven under power. Each of the driving wheels 85 engage flexible slurry line 46. Obviously the peripheries of wheels 79 and 85 are covered with a friction material to insure their driving relation with respect to slurry line 46.

Figure 10:
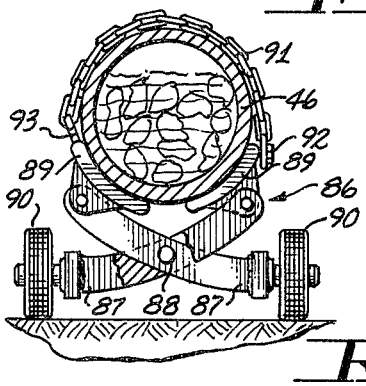
FIG. 10 is a detail taken as a vertical section through the flexible slurry line and illustrating one wheel set on which it rides, being taken on the plane of line 10—10 of FIG. 8.

It is desirable, if not absolutely essential, that flexible slurry line 46 be supported on some form of wheels to reduce resistance to its push-pull movement. Thus, upon referring now to FIG. 10, a slurry line carriage is designated generally 86. It comprises two arcuate arms 87 which are pivotally connected at their centers as indicated at 88, with the upper end of each arm having pivotally mounted thereon a slurry line engaging member 89. The lower end of each arm 87 has rotatably mounted thereon a wheel 90. A chain 91 has one end permanently anchored to one member 89 as indicated at 92 and its other end releasably connected to the other member 89 such as by a hook 93.

Figure 8:
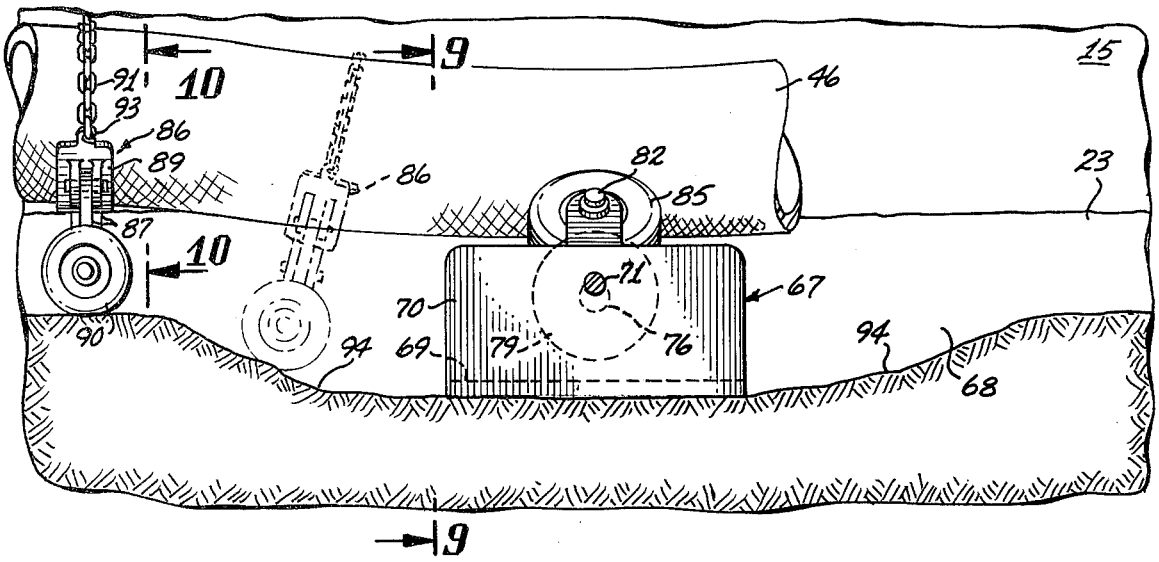
FIG. 8 is a detail taken on a vertical plane illustrating the movement of the flexible slurry line over the power unit which moves it, being taken on the plane of the line 8—8 of FIG. 6.

Referring now more particularly to FIG. 8, pit 68 in flume 25 is shown as formed with a ramp 94 at each end, speaking with reference to the longitudinal dimension of the flume, with a carriage 86 assembled on the flexible slurry line 46 as illustrated at the left hand side of FIG. 8. As this carriage approaches power unit 67 wheels 90 will ride down ramp 94 on that side and eventually be free of engagement with any supporting surface. It may then be readily moved by merely releasing chain 91 from hook 93. With slurry line 46 relieved of this supporting engagement it bears against the wheels 79 and 85 under gravity action to provide the engagement necessary for the driving action.

After that particular portion of the slurry line 46 passes the power unit 67 the carriage 86 is replaced and the wheels thereof ride up the other ramp 94 and thence along the bottom of the flume.

SLURRY LINE MOVEMENT

It is evident that as the slurry line turns a corner where a working tunnel meets a service tunnel, the power unit 67 holds that portion of the slurry line which enters the service tunnel against lateral displacement and centers it over the flume. It is now either pushed in the service tunnel towards one of the slurry tubes 21 or 24 or pulled away therefrom.

Referring now to FIG. 1 it will be noted that the upper end of each elbow 22 carries a short length of tube 95 the free end of which is cut away along a curve line 96 to facilitate entry of flexible slurry line 46 thereinto. It will be understood that as mobile mining unit 26 begins its travel away from its innermost limit in a working tunnel which has just been formed the free end of flexible slurry line will open onto and be received in the declined portion of flume 25. As this travel continues the free end of slurry line 46 will approach cut away tube 95 and eventually enter thereinto and be diverted downwardly into slurry tube 24 as indicated by the broken lines in FIG. 1. To accommodate this action, a friction reducing device is preferably provided. This device may take the form of rollers or bearings on either the interior of tube 95, elbow 22 and the open end portion of tube 24, or by similar elements mounted exteriorally of the end portion of slurry line 46. It will be understood that each flume 23 or 25 will be covered by removeable grills corresponding to those shown at 65.

THE MINING MACHINES

Referring now more particularly to FIG. 13, a known type of conventional mining machine includes a body indicated diagrammatically at 97 which is mounted on wheels 98 which may be power driven as indicated by a motor 99. A mechanical cutting member of the tooth-chain type is represented at 100 and is also power driven. Material mined by this cutting element 100 is passed onto an endless belt conveyor 102 which discharges into the slurry mix tank 35 that is mounted in auxiliary cart 103. The water is received in tank 35 from line 40 and the mixture of mined material and water is agitated and mixed by stirrers of a known type which are powered by the motor represented diagrammatically at 104. Slurry is removed from the slurry mix tank 35 by fixed slurry line 44. A pump 105 causes this withdrawal.

Provision is also made for causing the chain cutter 100 to swing laterally so to cut a working tunnel which is wider than the transverse dimension of body 97.

Referring now more particularly to FIGS. 14 and 15, a hybrid mining machine will be described. As shown in FIG. 14, this machine will include the same body 97, mounted on wheels 98, electric motor 99, mechanical cutting member 100, and conveyor 102 which are described above in connection with FIG. 13. In this connection it is noted that motor 99 will also drive conveyor 102.

A chassis comprises two side members 106 which are L shaped in cross section providing bottom rails and side flanges. This chassis is supported by six wheels 107 and a pair of traction wheels 108 driven by a power source such as the electric motor shown at 109. The upper end of conveyor 102 is supported by a vertical frame including side bars 110 having wheels 111 mounted on the lower ends. These wheels 111 ride on the rails of side bars 106. Thus, relative movement between body 97 of the conventional mining device and conveyor 102 and the chassis is accommodated. Mounted on the chassis provided by side bars 106 is a second body 112 which includes the slurry mix tank 36. A second conveyor 113 is mounted on the chassis with its lower end being positioned beneath the upper end of conveyor 102 and its upper end being disposed above slurry mix tank 36 to deliver mined aggregate thereto. A scraper 114 is provided to pick up aggregate which may have fallen off the conveyor and possibly water which may have been combined therewith and this picked up material is delivered to slurry mix tank by a pump 115. Conveyor 113 is powered by a motor shown at 116 and a drive belt 117.

Upstanding from each side bar 106 is a vertical strut 118 which together with body 112 support a platform 119. Mounted on this platform 119 is a frame like tower 120 which supports a jet nozzle 121 which may be swivelly mounted on the upper end of a pipe 122 which is connected by a horizontal pipe 123 to water line 40. Pipe 123 includes a valve 124 and a pump 125 for building up required pressure in the jet which is discharged from nozzle 121.

Upstanding from the forward end of the chassis are a pair of vertical struts 126 which together with struts 118 support a shield 127 that is inclined from its outer free end to its inner end where it is spaced above conveyor 113. Thus, water and mined material mined by the jet fall onto this shield and then move rearwardly under gravity action on the conveyor 113. The middle portion of shield 127 is flared upwardly and outwardly into the shape of a section of a funnel to achieve maximum efficiency in collecting the material which results from the jet action. Slurry from tank 36 is withdrawn by pump 128 and passed through conduit 129 to fixed slurry line 44.

Figure 16:
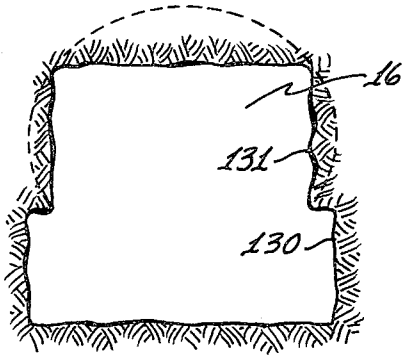
FIG. 16 is a schematic vertical section illustrating the contour of a working tunnel as it is cut by the mining machines of FIGS. 14 and 15 being taken on the plane of line 16—16 of FIG. 14.

FIG. 16 illustrates the contour of the working face which is formed by the hybrid mining machines of FIGS. 14 and 15. Thus, the lower portion 130 is formed by the conventional mechanical cutters and the upper alternate portions 131 are formed by the hybrid jet.

OPERATION

While the manner in which the instant push-pull mining system operates is believed to be obvious from the illustrations of the drawings and description of parts set forth above, it is briefly described as follows:

With the arrangement of service tunnels, flumes therein, holding tunnels formed, and the separation tank, main slurry mix tank, underground reservoir, surface reservoir, and the various conduits and tubes including the slurry tubes 21 and 24 installed, a mobile mining unit 26 is positioned in holding tunnel 16 and power station 67 is installed in the middle of service tunnel 14 just at the right of holding tunnel 16, speaking with reference to the showing of FIG. 4, and water station 43 positioned in the service tunnel to the left of the holding tunnel.

The mobile mining unit 26 is now starting in operation and the other traction elements, provided in the mining machine, move the mining unit to form working tunnel 28. This movement is accommodated due to the flexible properties of water line 42 and slurry line 46. The latter makes the turn at the corner between holding tunnel 16 and service tunnel 14 and is received on the driving wheels of the power unit. These driving wheels assert a pull on the flexible slurry line which is also subject to the push caused by the power driven traction units of the mining machines. Thus, the free end of the flexible slurry line is thrust into the flume and slurry is discharged into the declined portion thereof. At this point it is well to note that the mobile mining unit will have a length which is related to the particular formation to be mined and determines the length of the working tunnels. This length will probably be as great as 500 feet or considerably longer. However, in any event, the flexible slurry line will have an extent determined by the distance from the holding tunnel to chamber 17 and the movement of the flexible slurry line will be equal to one-half the length of the mobile mining unit. However, the distance penetrated by the mobile unit may be greater than its length and is dependent upon the length of the sloped portion of the flume and slurry tube which is effective.

As the mobile mining unit moves towards the service tunnel the flexible slurry line moves rearwardly in the flume in the service tunnel until its end approaches the cut away tube 95 at the upper end of slurry tube 24. It enters the latter and is continued downwardly therein until the completion of that phase of the mining stroke. The slurry falls down tube 24 under gravity action and into separation tank 18. Undesirable elements of the mined material are removed in separation tank 18 and the purified aggregate passes to main slurry mix tank 19. Water is added to the slurry in tank 19 from the underground reservoir 20 by a pump 132. The amount of water so added determines the consistency of the slurry. Excess, filtered water from slurry tank 19 may be drawn off through pump 132 by reservoir line 101. The slurry is then pumped upwardly to tank 63 for subsequent disposal.

At this point it is also well to note that the water from underground reservoir 20 is pumped upwardly in upflow tube 55 by pump 133.

While it is not a part of the present invention it is noted that if reservoirs 53 and 20 are of large capacity water will flow downwardly through downflow tube 54 to operate turbine 59 during normal working day-light hours and then return to surface reservoir 53 from underground reservoir 20 by pipe 134 under the influence of pump 135. Also a pump 136 draws the purified mined material from separation tank 18 and passes it to slurry tank 19.

Upon completion of this phase, the drives to the traction device in the mining machines will reverse to move the mobile mining unit in the opposite direction and motor 77 of power unit 67 is also reversed to withdraw slurry line 46 from tube 24.

Figure 11:
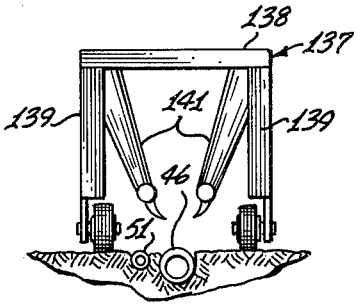
FIG. 11 is an elevation somewhat diagrammatic of a material carrier, being taken on the plane of the line 11—11 of FIG. 4.

To facilitate handling material and equipment in both the service and working tunnels, a material carrier is illustrated in FIGS. 4 and 11 and is designated generally 137. It comprises a table like top 138 and four legs 139 with a wheel 140 at the bottom of each leg. Two pairs of arms 141 are provided to support pipe sections and similar elements below top 138.

MODIFICATION

FIG. 2 illustrates a service tunnel 142 which has an inclined floor resulting in a flume 143 which is also inclined, thus facilitating the flow of slurry therealong. One or more of service tunnels in any mine may have such inclined floors. At no time is it necessary for the end of the slurry line to enter the slurry tube.

FIG. 3 illustrates the arrangement of separation tank, slurry tube leading thereto, and slurry mix tank which may be provided at the side of a hill 13. Thus, a reservoir 144 has an upflow tube 145 which includes a pump 146 which provides water through lines 51 from reservoir 144 to the mining machines. A lower service tunnel 147 has a floor formed with a flume 148 in which a flexible slurry line 149 is reciprocal as pointed out above in connection with slurry line 46. A slurry tube 150 having some slope to separation tank 151, communicates with flume 148 and receives the end of slurry line 149 in the manner above described. It discharges mined material in slurry form into a separation tank 151. A second slurry tube 152 extends from the flume line of an upper service tunnel 153.

While preferred specific embodiments of the invention are herein disclosed it is to be clearly understood that the invention is not limited to the exact constructions, mechanisms, and devices illustrated and described because various modifications of these details may be provided in putting the invention into practice.

What is claimed is:

1. In a push-pull mining system a. a substantially horizontal service tunnel having a floor formed with a central flume extending longitudinally thereof and having a declined portion;

b. a holding tunnel extending laterally from one side of, and at one end of said service tunnel;

c. a mobile mining unit positioned in said holding tunnel and comprising:

I. a pair of mining machines located at opposite ends of said unit with each machine including a slurry mix tank, II. a pump operatively connected with each of said slurry mix tanks.

III. a plurality of wheeled carriers between said mining machines and including a mid-carrier;

IV. a fixed water line extending between said machines, supported by said carriers, and communicating with the slurry mix tanks in said mining machines, and V. a fixed slurry line extending between said mining machines, being connected to said pumps, and supported by said carriers, d. a mobile water station connected to a water supply source;

e. a flexible water line extending from said station to said mid-carrier where it is connected to said fixed water line;

f. valve means for establishing communication between said flexible water line through said fixed water line to one of said slurry mix tanks to the exclusion of the other mix tank;

g. a flexible slurry line extending from said mid-carrier where it is connected to said slurry line, and having a length in excess of one-half the length of said mobile mining unit;

h. valve means for establishing communication between said flexible slurry line through said fixed slurry line to the slurry mix tank of one mining machine to the exclusion of the slurry mix tank of the other mining machine;

i. power driven traction means in said mining unit for moving said unit out of said holding tunnel, across said service tunnel to form a working tunnel on the side of said service tunnel opposite to said working tunnel, and then back across the service tunnel to form a second working tunnel behind said holding tunnel, making turns as it does so, and so on to form a plurality of working tunnels extending laterally from said service tunnel;

j. a power station removably positioned in said service tunnel in the vicinity of the junction of a working tunnel therewith and including means for drivably engaging said flexible slurry line to exert a push and pull thereon and maintain that portion of the flexible slurry line which is positioned in the service tunnel against lateral displacement whereby it extends into said flume;

k. a main slurry mix tank below said service tunnel, and l. a slurry tube connected to said main slurry mix tank and extending upwardly to said flume where its upper end portion is deformed to slideably receive the free end of said flexible slurry line.

2. The push-pull mining system of claim 1 together with an additional service tunnel located at a level different from that of said service tunnel with said additional service tunnel having a holding tunnel extending therefrom and receiving another mobile mining unit at the start of mining operations on opposite sides of said additional service tunnel, and a second slurry tube extending from said main slurry mix tank to the flume in said additional service tunnel and having an end portion which slideably receives the free end of a flexible slurry line.

3. The push-pull mining system of claim 1 in which there is a separation tank included in the connections of said slurry tube to said main slurry mix tank.

4. The push-pull mining system of claim 1 in which each of the valve means at the mid-carrier is a three-way valve.

5. The push-pull mining system of claim 1 in which the water supply for the mobile water station comprises a sectioned pipe extending along said service tunnel, a surface reservoir, an underground reservoir, a downflow tube extending between said reservoirs, an upflow tube having its lower end connected to said underground reservoir, and valve means for connecting said pipe to one of said tubes to the exclusion of the other.

6. The push-pull mining system of claim 1 together with wheeled carriages which support said flexible slurry line in its movement toward and away from said power station and which are removable from the flexible slurry line to accommodate movement over said power station.

7. The push-pull mining system of claim 6 in which the power station includes a motor and three wheels which are driven by said motor and driveably engage the flexible slurry line due to the gravity action of that portion of the flexible slurry line which has the carriages removed therefrom.

8. The push-pull mining system of claim 1 together with a mill in a carrier on each side of the mid-carrier for reducing the size of mined material aggregate in the fixed slurry line.

9. The push-pull mining system of claim 1 in which each mining machine comprises mechanical cutters which are swingable on a horizontal plane.

10. The mining system of claim 1 in which the service tunnel has a slight decline towards the upper end of the slurry tube.

11. The push-pull mining system of claim 1 in which the power station is movable from one position to another in said service tunnel together with means for fixedly securing the power station in a desired position in said service tunnel.

12. The push-pull mining system of claim 1 in which each of said mining machines comprises a mechanical cutter swingable on a horizontal plane together with a hydraulic jet operable on the zone above and behind the mechanical cutter.

13. The push-pull mining system of claim 12 in which the mechanical cutter is movable relative to the hydraulic jet.

14. The push-pull mining system of claim 13 in which there are a pair of overlapping conveyors extending away from the mechanical cutters together with a shield interposed between the hydraulic jet and the overlap of said conveyors.

15. The push-pull mining machine of claim 12 together with a mobile material carrier comprising a top panel, four legs depending from said top panel, a wheel on the lower end of each leg, and complemental arcuate arms depending from the panel and between said legs whereby said material carrier is adapted for movement in a service tunnel by straddling the flume therein and movement in a working tunnel by straddling a mobile mining unit therein to convey materials required at a particular site.

16. The push-pull mining system of claim 1 together with grill plates which cover the flumes in the floor of said service tunnel and which are removable.

* * * * *